United States Patent [19]

Sturm

[11] Patent Number: 4,702,099

[45] Date of Patent: Oct. 27, 1987

[54] METHOD FOR AUTOMATICALLY ADJUSTING THE ROLLS IN A UNIVERSAL TYPE MILL STAND

[75] Inventor: Hans Sturm, Oberhausen, Fed. Rep. of Germany

[73] Assignee: Mannesmann AG, Duesseldorf, Fed. Rep. of Germany

[21] Appl. No.: 818,171

[22] Filed: Jan. 10, 1986

[30] Foreign Application Priority Data

Jan. 19, 1985 [DE] Fed. Rep. of Germany ..... 3501622

[51] Int. Cl.[4] ..... B21B 13/10; B21B 31/16; B21B 37/08

[52] U.S. Cl. ..... 72/366; 72/20; 72/21; 72/238; 72/244; 72/366; 72/225

[58] Field of Search ..... 72/225, 238, 20, 21, 72/244, 365, 366, 237, 239

[56] References Cited

U.S. PATENT DOCUMENTS 3,968,672 7/1976 Kamogawa et al. ..... 72/225
4,127,997 12/1978 Quehen ..... 72/225 X

*Primary Examiner*—Robert L. Spruill
*Assistant Examiner*—Steve Katz
*Attorney, Agent, or Firm*—Ralf H. Siegemund

[57] ABSTRACT

The rolls of a universal type mill stand are adjusted by moving the lower horizontal roll into position, directly or iteratively, by shifting the upper horizontal roll axially under utilization of the vertical rolls. In the case of conical rolls the latter operation is included in the iteration to obtain minimum spacing between the vertical rolls. The position of all rolls under rolling pressure serves as reference for further adjustment towards dimensions of the stock.

4 Claims, 1 Drawing Figure

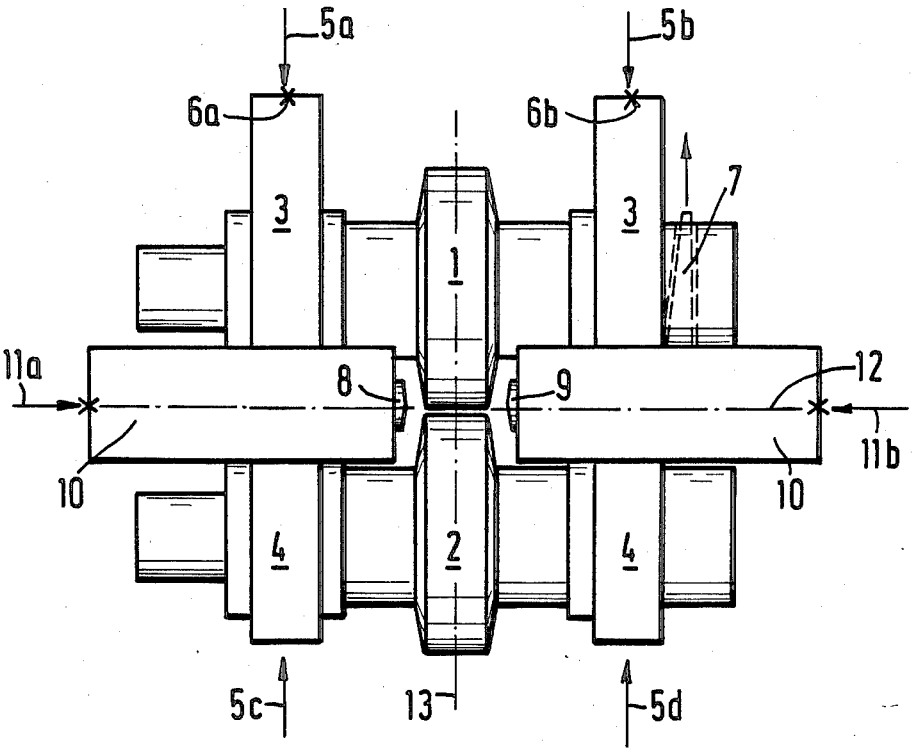
5a
5b
6a
6b
3
3
7
1
11a
8
9
12
11b
10
10
4
2
4
5c
13
5d

METHOD FOR AUTOMATICALLY ADJUSTING THE ROLLS IN A UNIVERSAL TYPE MILL STAND

BACKGROUND OF THE INVENTION

The present invention relates to the automatic adjustment of the rolls in a stand of a rolling mill of the universal variety and more particularly the invention relates to the automatic adjustment of mills as referred to above wherein upper and lateral adjustment of the rolls is carried out with the aid of pressure sensitive transducers and the position of the adjusting spindles of the vertical rolls are ascertained by means of ascertaining angular displacement position, phase and rotation.

The exchange of rolls in a rolling stand of mill of the universal type requires generally that in each instance the rolls are adjusted in relation to the line of rolling under further consideration of the dimensions of the material being rolled. In the past this adjustment has been carried out manually and requires therefore considerable amount of time as well as relatively high skill of the personnel operating the rolling mill.

DESCRIPTION OF THE INVENTION

It is an object of the present invention to provide a new and improved method for automation of the adjustment of rolls in a rolling mill stand of the universal variety, which method is to be simpler and operates as fast as possible as well as exactly as possible under avoidance of manual intervention.

It is a particular object of the present invention to provide for a new and improved automated adjustment of rolls in a stand of universal type rolls wherein upper and lateral roll adjustment is ascertained by means of pressure sensitive transducers and wherein through angle encoders or the like one obtains the position of the adjusting spindle of the vertical rolls.

In accordance with the preferred embodiment of the present invention it is suggested to proceed as follows for purposes of carrying out the objects of the invention. The lower one of two horizontal rolls is initially adjusted corresponding to its diameter, towards the horizontal center plane of rolling; the upper roll is adjusted by moving it in a creepinglike fashion towards the lower roll until through pressure sensitive transducers a rolling pressure is ascertained; subsequently the upper roll is slowly retracted until the rolling pressure as indicated has dropped to zero whereupon the axial fastening of the upper roll such as a wedge or wedges are released. In addition, the vertical rolls in the stand are moved towards the rolling center (vertical plane) whereby depending on the results of the previous steps these vertical rolls may abut one side of the upper roll or the other side and shift the same in axial direction until both vertical rolls abut the sides of the lower roll. Thereupon the upper roll is fixed axially in that position. Finally all rolls are positioned for attaining rolling pressure. This is a disposition to serve in terms of signal represenation as reference nulling or for an operating computer.

Owing to the fact that the rolls are in various ways adjusted towards an abutting position particularly as far as the first operating step is concerned and towards an indication of rolling pressure one is in a position to adjust the position of the rolls in such a way that, as a starting point, the lower roll has a position with respect to the rolling center that serves as a general point of reference. The thus fixed position for the lower roll permits the orientation as far as subsequent operating steps are concerned in that the upper roll and the vertical rolls are oriented with respect and in reference to the lower roll in the particular sequence of steps as stated above. This operation permits realization of an exact and automated rolling adjustment.

After all the various steps as delineated above have been carried out the resulting positions are also stored in a computer and in combination the final adjustment for each and all of these rolls serves as reference position as outline above. This is, as far as the computer is concerned, an available set of reference data for subsequent adjustment of a new set of rolls towards a different or the same type of rolling stock.

In the case of universal roll stand with conical rolls one will preferably provide an adjustment of the lower rolls towards the rolling center by in an iterative fashion under utilization of the vertical rolls as long as necessary against the sides of the horizontal rolls and retracting them therefrom while concurrently the horizontal rolls are adjusted vertically. This positioning of the lower rolls is carried out until the position measurement of the vertical roll upon abutment on the sides of the horizontal rolls indicate the lowest possible opening. This aspect of practicing the invention therefore utilizes the fact that the opening dimension of the vertical rolls is the smallest whenever the horizontal are exactly adjusted on the rolling center. For this reason one will shift the horizontal rolls in vertical direction until the position measurement for the vertical rolls indicates indeed the smallest value for the opening between them.

Alternatively and generally adjustment of the lower rolls with respect to the rolling center may be carried out by means of an optical procedure whereby a light barrier is used, being oriented and directed towards the rolling gap. The control output of the light barriers permits derivation of an indication for the level of the rolls.

In the case of an oblique position of the upper roll vis-a-vis the lower roll this oblique position can be ascertained in that upon abutment of the horizontal rolls a large differential in rolling pressure is ascertained through two exactly spaced transducers and ascertaining rolling pressure to both sides of the upper roll. Adjusting the obliqueness of the upper roll is carried out for purposes of attaining uniformity until this error is indicated by the pressure transducer outputs as being compensated.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

the FIGURE illustrates a view through and into a rolling mill stand of the universal variety with additional representation for purposes of explaining the method in accordance with the preferred embodiment of the present invention for practicing the best mode thereof.

Proceeding now to the detailed description of the drawings, reference numerals 1 and 2 respectively refer to the upper and lower, horizontally positioned rolls in a universal mill stand as illustrated. These two rolls are respectively mounted in structures 3 and 4 permitting removal of the respective rolls from the stand. By means of these mounts 3 and 4 rolls 1 and 2 are movable in the vertical direction as indicated by the arrows 5*a*, 5*b*, 5*c* and 5*d*. This movability and adjustability is per se conventional. The two mounts 3 and 4 are provided with transducers 6*a* and 6*b* for measuring the rolling pressure on a basis which permits balancing of independent measurement to the left and to the right of roll 1 and does not have to rely on inherent or assumed averaging by a simple instrument. In addition the upper roll 1 can be shifted in axial direction which is also known per se, and the axial position is arrested through a wedge element 7 which locks the upper roll 1 to a stationary frame part that is not shown. Again this kind of arrangement is known per se.

The stand includes in addition a left hand vertical roll 8 and a right hand vertical roll 9. These rolls 8 and 9 are individually mounted in removable mounts 10 whereby lateral adjustment is permitted as indicated by the arrows 11a and 11b. Again, the direction of adjustment is axial or, better, axis parallel as far as the rolls 8 and 9 are concerned.

Reference numeral 12 indicates the center plane of rolling and the vertical plane of the rolling stand through the rolling center is represented by reference numeral 13.

After having described the equipment by means of which the invention can be practiced, the inventive procedure will be explained with reference to these various elements. The adjustment of the rolls begins generally by vertically adjusting the lower roll 2 as indicated by the arrows 5*c* and 5*d* so as to be aligned with the horizontal plane 12 that runs through the center of rolling. The adjusting position is monitored, e.g. optically by means of a light curtain barrier or the like, or in the case of conical rolls the adjustment of the lower roll is carried out in a manner that will be described below and was briefly allude to in the general description of the invention.

As soon as the lower roll has been adjusted to the aformentioned and defined position the drive for the mounts 3 of the upper roll 1 is operated but at a reduced power to slowly lower the upper roll 1 as indicated by the arows 5*a* and 5*b*. This rather gentle adjustment continues until the transducers 6*a* and 6*b* indicate rolling pressure. The abutment position of rolls 1 and 2 particularly in the last millimeter portion of the displacement path of roll 1 is carried out at a very low speed. As soon as rolling pressure is indicated lowering of the upper roll 1 is interrupted and stopped. Of course the transducer 6*a* and 6*b* can generally be expected not to indicate equal values. Certain tolerances are permissible but if the pressure differential as measured by the transducer 6*a* and 6*b* is too large then the drives for lowering the upper roll 1 will be operated to obtain seemingly an oblique disposition such that the pressure differential as indicated by the transducer 6*a* and 6*b*, drops at least below the permissible tolerance.

This adjustment position in terms of position values is ascertained and, possibly, stored in a computer. Subsequently the upper roll 1 is retracted slightly and just to the extent that the pressure in the transducer 6*a* and 6*b* drops to zero. At the same time wedge 7 is removed so as to free the roll 1 form its previous axial disposition. Thereafter the two mounts 10 are moved as indicated by arrows 11*a* and 11*b* towards the vertical plane 13 in the stand. This lateral shifting of the two mounts 10 along arrows 11*a* and 11*b* is continued until one or the other of the vertical rolls 8 and 9 abuts one of the sides of the roll 1. The motion of that vertical roll and through its mount 10 is continued to thereby change the axial disposition of the roll 1. The horizontal adjustment of the vertical rolls 8 and 9 is primary with regard to the then fixed position of the roll 2 and is stopped when the rolls 8 and 9 abut the sides of the roll 2. The lateral axial position of roll 1 then attained is such that the roll 1 is now in fact directly positioned above the roll 2 and its sides will not impede the adjustment of rolls 8 and 9 vis-a-vis roll 2.

Having thus adjusted axially the roll 1 the wedge 7 is re-inserted and the axial position of the roll 1 is now arrested in that position. Finally all rolls 1,2, 8 and 9 are adjusted to attain rolling pressure which pressure is an indication for then ascertaining exactly the position of all these rolls through appropriate position transducers. The position values thus obtained are stored in the operating computer. These values serve as null and reference points and value, and their acquisition completes the initial adjustment. If adjusting pressures are needed which are larger than attainable through the usual adjusting motors, hydraulic devices are provided as supplement.

If the rolls 1 and 2 are of conical configuration their adjustment in relation to the central plane 12 can be carried out as follows. The position of the vertical rolls 8 and 9 is carried out by means of adjusting spindles i.e. the movements 11*a* and 11*b* are produced through such spindles cooperating with position transducers to permit accurate ascertaining of the angular position of that spindle. Subsequently the vertical rolls are slightly retracted and the rolls 1 and 2 are vertically moved as needed. After each change of the position in rolls 1 and 2 the vertical rolls 8 and 9 are again run towards the sides of these rolls 1 and 2 and the opening measurement of the thus positioned rolls 8 and 9 is ascertained through the angle encoder of the spindle. Should the opening dimension of the vertical rolls increase then in the next cycle the horizontal rolls are shifted vertically by twice the step length used previously while the vertical rolls are retracted. Upon causing the vertical rolls 8 and 9 again to abut the sides of rolls 1 and 2 anew, one obtains a new opening dimension. This stepwise procedure is repeated until the dimension of the opening between the vertical rolls has passed through its lowest value and is increasing again. Thereafter the adjustment of the horizontal rolls is retracted and a position corresponding to minimum opening is restored. This iterative procedure positions simultaneously the lower roll exactly with reference to the center of the stand.

This last mentioned procedure cannot be carried out in universal stands with cylindrical rolls, but such trial and error procedure is not required for cylindrical rolls because as was mentioned above, the lower roll is adjusted initially for example under utilization of a light barrier or the like that "looks" through the rolling gap, and the signals representing light intensity are used as input for the automatic adjustment of the rolls in relation to the rolling level. Also, the position and size of the lower roll can be measured by means of a device operating on the stand.

The invention is not limited to the embodiments described above but all changes and modifications thereof, not constituting departures from the spirit and scope of the invention, are intended to be included.

I claim:

1. Method for automatically adjusting the rolls in a universal type rolling mill stand the stand including horizontally positioned upper and lower rolls and vertically positioned vertical rolls comprising the steps of:

adjusting the lower roll in a vertical direction and corresponding to its rolling diameter and in particular relation to a horizonally extending center plane of rolling;

adjusting the upper roll towards the lower roll at a relatively low speed until rolling pressure is indicated through separate pressure measurement;

retracting slowly the upper roll until rolling pressure has reduced to zero;

releasing the upper roll as far as its axial disposition is concerned;

moving the vertical rolls towards each other, said vertical rolls being in abutment with said upper roll so that upon movement of the vertical rolls the upper roll is shifted to a position such that both said vertical rolls abut the sides of the lower roll;

arresting the axial position of the upper roll;

moving all rolls to attain rolling pressure; and ascertaining values indicative of respective positions for the rolls after completion of all preceding steps.

2. Method as in claim 1 and including the step of adjusting the lower roll as per the initial adjusting step by optical means.

3. Method as in claim 1 and including the step of measuring rolling pressure as well as any pressure on the upper and lower rolls in two axially displaced positions and to opposite sides of the upper roll; and tilting the upper roll in case of a pressure differential until the pressure differential has dropped below tolerance values.

4. Method as in claim 1 wherein said upper and lower rolls are of conical configuration and including the step of adjusting the lower roll, following said moving step under utilization of the vertical rolls by moving the vertical rolls towards the horizontal rolls and retracting them therefrom followed by adjustment of the relative disposition of the horizontal rolls in relation to each other in repeated cycles until the vertical rolls abut against the sides of the horizontal rolls and define between them a smallest dimension of spacing opening between the horizontal rolls.

* * * * *